US005312097A

United States Patent [19]

Womack

[11] Patent Number: 5,312,097

[45] Date of Patent: May 17, 1994

[54] DOUBLE C CLAMP DEVICE

[76] Inventor: Terry R. Womack, Rte. 1 Box 575 Z, Forest City, N.C. 28043

[21] Appl. No.: 993,440

[22] Filed: Dec. 21, 1992

[51] Int. Cl.[5] ..... B25B 1/00

[52] U.S. Cl. ..... 269/139; 269/249; 269/221; 269/258

[58] Field of Search ..... 269/283, 249, 139; 219/221, 152, 258, 266

[56] References Cited

U.S. PATENT DOCUMENTS

| | | | |
|---|---|---|---|
| 416,244 | 12/1889 | Weller | 269/221 |
| 1,328,492 | 1/1920 | Carman | 269/139 |
| 1,497,107 | 6/1924 | Lasell | 269/249 |
| 3,063,707 | 11/1962 | Kelley | 269/221 |
| 3,499,206 | 3/1970 | Querhheim | 269/283 |
| 4,363,475 | 12/1982 | McCarty | 269/283 |
| 4,437,654 | 3/1984 | Chiappetti | 269/283 |
| 4,824,085 | 4/1989 | Buchler | 269/139 |
| 4,834,354 | 5/1989 | Yang | 269/249 |
| 4,858,902 | 8/1989 | Hickman | 269/139 |

*Primary Examiner*—Robert C. Watson
*Attorney, Agent, or Firm*—Richard L. Miller

[57] ABSTRACT

A double C-clamp device is provided which consists of a pair of C-clamps, each having a fixed jaw and a moveable jaw and a pair of clamp bars. A fastening structure is for attaching the first clamp bar transversely between the fixed jaws and the second clamp bar transversely between the moveable jaws of the C-clamp. The C-clamps which are in a stationary spaced apart relationship can cause the clamp bars to come towards each other to hold a work piece which may be tapered an have irregular shaped contact surfaces.

6 Claims, 1 Drawing Sheet

DOUBLE C CLAMP DEVICE

BACKGROUND OF THE INVENTION

The instant invention relates generally to C-clamps and more specifically it relates to a double C-clamp device.

Numerous C-clamps have been provided in the prior art that are adapted to hold various types of work articles together. For example, U.S. Pat. Nos. 4,691,907 to Yang; 4,828,241 to Yang and 4,962,918 to Yang all are illustrative of such prior art. While these units may be suitable for the particular purpose to which they address, they would not be as suitable for the purpose of the present invention as hereafter described.

SUMMARY OF THE INVENTION

A primary object of the present invention is to provide a double C-clamp device that will overcome the shortcomings of the prior art devices.

Another object is to provide a double C-clamp device that permits items to be clamped on surfaces which are not parallel with each other.

An additional object is to provide a double C-clamp device that has a plurality of fitting attachments so as to permit items to be clamped on surfaces which are irregular and curved in some manner.

Yet another object is to provide a double C-clamp device that contains a double gripping action that will find its greatest uses in the home, construction and industrial fields.

Yet an additional object is to provide a double C-clamp device that is a very safe tool, because of its double gripping action, it is less likely to fail under stress loads.

A further object is to provide a double C-clamp device that is simple and easy to use.

A still further object is to provide a double C-clamp device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
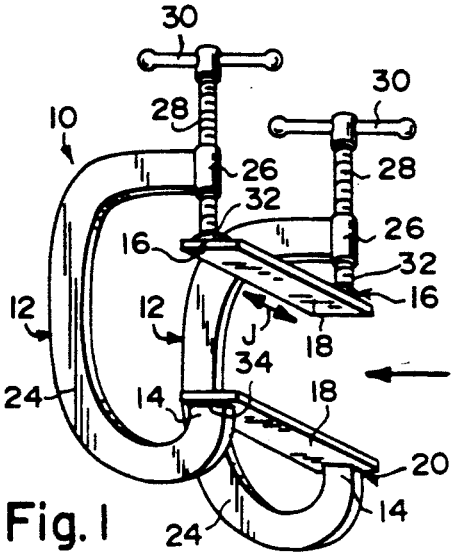
FIG. 1 is a diagrammatic perspective view illustrating the instant invention.

Turning now descriptively to the drawings, in which similar reference characters denote similar elements throughout the several views, the Figures illustrate a double C-clamp device 10 which consists of a pair of C-clamps 12, each having a fixed jaw 14 and a moveable jaw 16 and a pair of clamp bars 18. A fastening structure 20 is for attaching the first clamp bar 18 transversely between the fixed jaws 14 and the second clamp bar 18 transversely between the moveable jaws 16 of the C-clamps 12. The C-clamps 12 which are in a stationary spaced apart relationship can cause the clamp bars 18 to come towards each other to contact a work piece 22.

Figure 6:
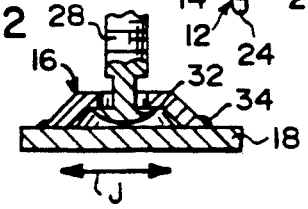
FIG. 6 is an enlarged diagrammatic cross sectional view with parts broken away of the area indicated by arrow 6 in FIG. 2.
Figure 3:
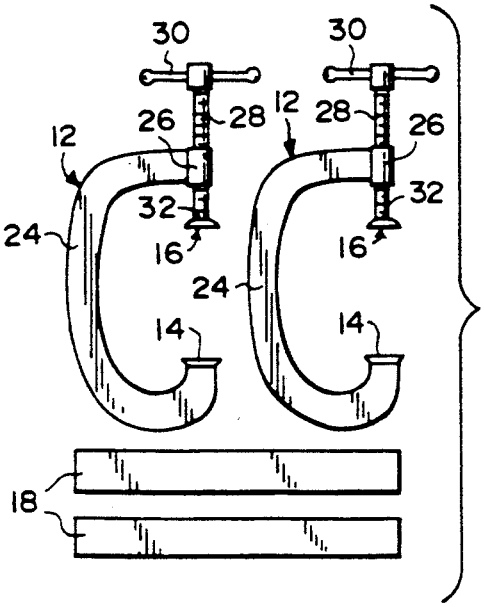
FIG. 3 is an exploded elevational view illustrating the components required to fabricate the instant invention.
Figure 5:
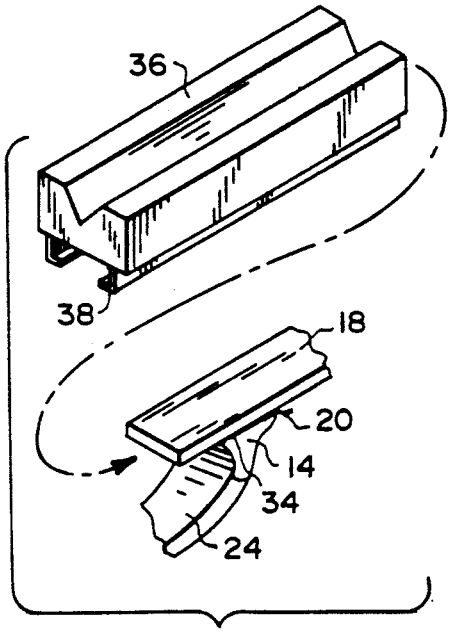
FIG. 5 is an enlarged diagrammatic perspective view with parts broken away showing how a lower fitting attachment in FIG. 4B is installed on the lower clamp bar of the instant invention.

Each C-clamp 12 includes a C-shaped frame 24 having the fixed jaw 14 at a first end and an internally threaded collar 26 at a second end. An operating screw 28 is mated with the internally threaded collar 26, while a transverse handle 30 is provided on an outer end thereof for rotating the screw 28. As best seen in FIG. 6, a swivel head 32 is formed on an inner end of the operating screw 28, which has the moveable jaw 16 attached thereon in such a manner as to not only permit the rotation of the swivel head with respect to the jaw 16, but which also permits a slight amount of side ways displacement of the jaw 16 with respect to the swivel head 32, as indicated by arrow J.

The fastening structure 20 is a plurality of welds 34 for retaining the clamp bars 18 to the fixed jaws 14 and the moveable jaws 16.

The double C-clamp device 10 may further cooperate with at least one fitting attachment 36 having a track 38 thereon, so that it can be installed on one of the clamp bars 18 to clamp a cylindrical work piece 40 therebetween.

Figure 2:
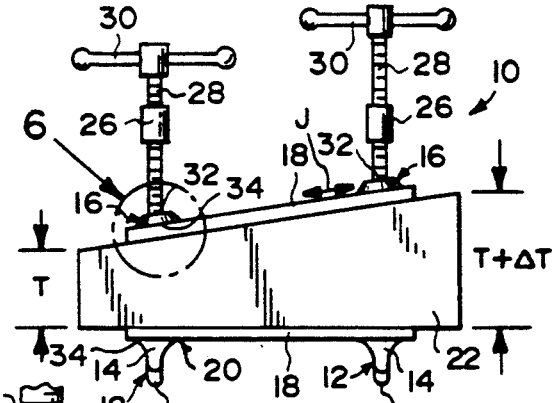
FIG. 2 is an elevational view taken generally in the direction of arrow 2 in FIG. 1 illustrating the clamping of a work piece which is slightly tapered.

As shown in FIG. 2, the operating screws 28 can be turned at different amounts, so that the upper clamp bar 18 can make proper contact with a work piece 22 that is tapered.

Figure 4A:
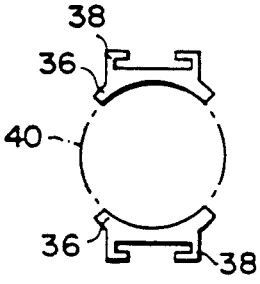
FIG. 4A, 4B, 4C and 4D are diagrammatic view showing various typical fitting attachments.
Figure 4B:
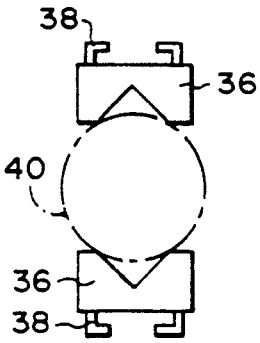
Figure 4C:
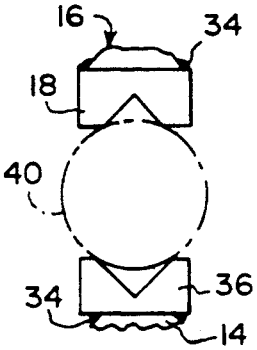
Figure 4D:
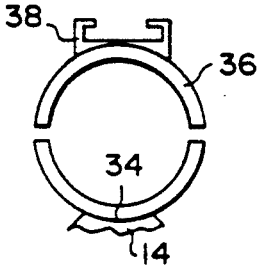

The fitting attachment 36 can be curved as shown in FIGS. 4A and 4D. It also can have a V-shaped notch, as shown in FIGS. 4B and 4C. The curved shaped and the V-shaped notch will allow the device 10 to retain cylindrical work pieces 40, such as pipes, tubes, rods and similar articles.

The devices 10 and the fitting attachments 36 can be made out of various durable materials and come in different sizes for different types of clamping jobs to be accomplished.

The fitting attachments 36 can be alternatively permanently secured without the track 38, in which case it is welded at 34 directly to the jaw or jaws 14 and 16 of the frame 24 and operating screw 28 respectively of the C-clamps 12, as shown in FIGS. 4C and 4D.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A double C-clamp device which comprises:

a) a pair of C-clamps, each having a fixed jaw and a moveable jaw and including:
   i) a C-shaped frame having said fixed jaw at a first end and an internally threaded collar at a second end;
   ii) an operating screw mating with said internally threaded collar;
   iii) a transverse handle on an outer end of said operating screw for turning said operating screw; and
   iv) a swivel head formed on an inner end of said operating screw having said moveable jaw thereon which swivel head simultaneously permits limited side ways translational displacement of the jaw with respect to said swivel head and rotation of the swivel head with respect to the jaw;
b) a pair of clamp bars; and
c) means for attaching said first clamp bar transversely between said fixed jaws and said second clamp bar transversely between said moveable jaws of said C-clamps, so that said C-clamps which are in a stationary spaced apart relationship can cause saic clamp bars to come towards each other to contact a work piece.

2. A double C-clamp device as recited in claim 1, wherein said attaching means includes a plurality of welds for retaining said clamp bars to said fixed jaws and said moveable jaws.

3. A double C-clamp device as recited in claim 1, further including at least one fitting attachment having a track thereon, so that it can be slidely installed on one of said clamp bars to permit clamping on an appropriate irregular surface.

4. A double C-clamp device as recited in claim 1, further including at least one fitting attachment permanently secured on one of said clamp bars to permit clamping on an appropriate irregular surface.

5. A double C-clamp device as recited in claim 1, further including at least one fitting attachment integrally formed with one of said clamp bars to permit clamping on an appropriate irregular surface.

6. A double C-clamp device as recited in claim 1, wherein said swivel head comprises a shank having an enlarged, convex force-applying tip formed on said inner end of said operating screw and a dished washer having a cup portion of larger radius than a radius of the force-applying tip and surrounded by a radially outer peripheral flange for attachment to said second clamp bar, the washer receiving said shank as a free fit with said enlarged convex force applying tip trapped as a free fit within said cup portion between the washer and the second clamp bar.

* * * * *